United States Patent [19]

Koshida

[11] Patent Number: 4,773,381

[45] Date of Patent: Sep. 27, 1988

[54] ROTATIONAL SIGNAL DETECTING APPARATUS FOR INTERNAL COMBUSTION ENGINE

[75] Inventor: Ryoichi Koshida, Katsuta, Japan

[73] Assignee: Hitachi, Ltd., Tokyo, Japan

[21] Appl. No.: 367

[22] Filed: Jan. 5, 1987

[30] Foreign Application Priority Data

Jan. 8, 1986 [JP] Japan ..... 61-612

[51] Int. Cl.[4] ..... F02P 5/00; F02P 1/00

[52] U.S. Cl. ..... 123/630; 123/613; 123/617

[58] Field of Search ..... 123/613, 617, 630, 640, 123/622

[56] References Cited

U.S. PATENT DOCUMENTS

| | | | |
|---|---|---|---|
| 4,086,894 | 5/1978 | Caparka et al. | 123/613 |
| 4,416,245 | 11/1983 | Taft et al. | 123/613 |
| 4,457,286 | 7/1984 | Katayama et al. | 123/617 |
| 4,483,293 | 11/1984 | Akasu | 123/630 |
| 4,493,307 | 1/1985 | Trinh et al. | 123/630 |
| 4,635,353 | 1/1987 | Tamagne | 123/617 |

*Primary Examiner*—Raymond A. Nelli

*Attorney, Agent, or Firm*—Antonelli, Terry & Wands

[57] ABSTRACT

There is provided a rotational signal detecting apparatus comprising a housing, a rotor shaft attached to said housing so as to be freely rotatable, said rotor shaft rotating in synchronism with a crankshaft or a cam shaft of an engine, a photoelectric pickup comprising a rotating portion fixed to said rotor shaft so as to rotate with said rotor shaft as one body and a fixed portion integrally attached to said housing, said fixed portion having photoelectric conversion means for outputting a signal varying according to the quantity of incident light varied in synchronism with the rotation of said rotating portion, an electromagnetic pickup comprising a rotating portion fixed to said rotor shaft so as to rotate with said rotor shaft as one body and a fixed portion integrally attached to said housing, said fixed portion having magnetic field detecting means for outputting a signal varying according to the magnetic field varied in synchronism with the rotation of said rotating portion, one of said photoelectric pickup and said electromagnetic pickup being used as the backup for the other.

14 Claims, 9 Drawing Sheets

ROTATIONAL SIGNAL DETECTING APPARATUS FOR INTERNAL COMBUSTION ENGINE

BACKGROUND OF THE INVENTION

The present invention relates to a rotational signal detecting apparatus suitable for detecting the rotation speed or crank angle phase of an internal combustion engine.

In conventional methods for detecting the rotation speed and the crank angle phase, an electromagnetic pickup or a photoelectric pickup is used. In an example of the detection method using an electromagnetic pickup, a reluctor having a plurality of projections is fixed to the rotation shaft rotating in synchronism with the rotation of the engine to produce an alternating field varying in synchronism with the rotation of the engine, and the alternating field is detected by using a electromagnetic pickup coil.

In an example of the detection method using a photoelectric pickup, a slit plate is attached to the rotation shaft, and the light of a light emitting diode is applied to a light receiving diode via a slit of the slit plate to vary the amount of light received by the light receiving diode in synchronism with the rotation of the engine.

The rotation speed and the crank angle phase are basic information for controlling the internal combustion engine. Once the rotation speed or the crank angle phase becomes undetectable, i.e., once the apparatus for detecting these signals becomes faulty, the engine cannot be run normally. In a scheme proposed recently, at least two systems of detecting apparatus are disposed when these important signals are to be detected. Under the normal condition, one system is actually used and the other system is reserved for backup. Should one system fail, the other system is used to detect the information.

An example of such a scheme using two systems of electromagnetic pickups is described in a journal entitled "Nikkei Mechanical" published in Japan on Dec. 22, 1982, pp. 81–89. In this case, the crank angle phase is detected by one of the electromagnetic pickups. Should the detection of the crank angle phase become impossible because of a trouble incurred in the pickup coil of the above described one electromagnetic pickup, the crank angle phase is detected by the other electromagnetic pickup.

If two electromagnetic pickups are disposed and the space housing the pickups is limited, however, the two electromagnetic pickups must be disposed close together. Accordingly, the magnetic fields of the pickups interfere each other, resulting in deteriorated signal detection precision.

It is also proposed to use two or more systems of photoelectric pickups. Since dust or the like is deposited on the light emitting face of the light emitting device and the light receiving face of the light receiving device with the elapse of time, the amount of the received light is decreased, resulting in deteriorated signal detection precision. Further, a large space is demanded since two slit plates are disposed. Accordingly, it is not so desirable to dispose two systems of photoelectric pickups and use one pickup as the backup for the other pickup.

SUMMARY OF THE INVENTION

An object of the present invention is to provide a rotational signal detecting apparatus which is free from the above described drawbacks of the conventional rotational signal detecting apparatus and which is high in signal detection precision.

In accordance with the present invention, therefore, two systems composed of an electromagnetic pickup and an optical pickup are disposed, and the other system is used as the backup for one system.

That is to say, the electromagnetic pickup and the photoelectric pickup respectively use the magnetic field and light as media for detecting the rotational signal. Since the magnetic field and the light do not affect each other, the detection precision of the rotational signal is not deteriorated even if those pickups are arranged close together. In the electromagnetic pickup, the detection precision is not deteriorated with time unlike the optical pickup, resulting in constant detection precision.

DESCRIPTION OF THE PREFERRED EMBODIMENTS

Embodiments of the present invention will now be described in detail with reference to accompanying drawings.

Figure 1:
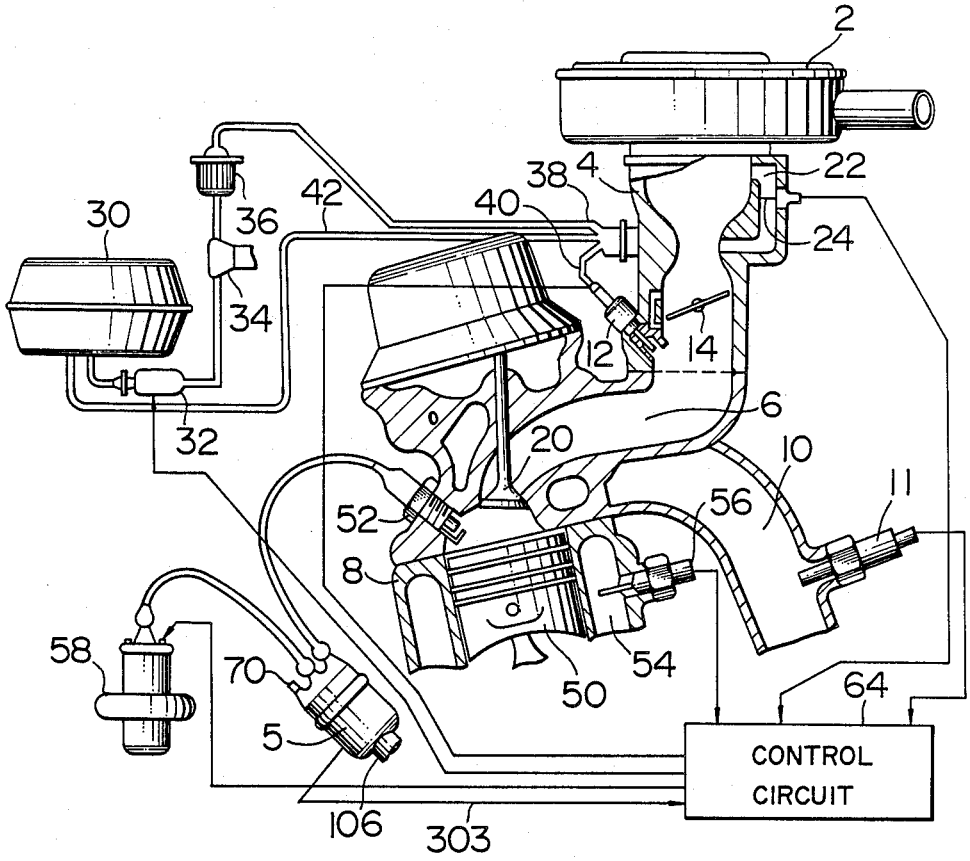
FIG. 1 is a configuration diagram of an example of an internal combustion engine whereto the present invention is to be applied.

FIG. 1 shows an example of configuration of an internal combustion engine whereto the present invention is to be applied. In this example, a rotational signal detecting apparatus according to the present invention is contained in a distributor for internal combustion engine.

In FIG. 1, suction air is supplied to a cylinder 8 through an air cleaner 2, a throttle chamber 4, and a suction pipe 6. A gas burnt in a cylinder 8 is discharged from the cylinder 8 to the atmosphere through an exhaust pipe 10. An injector 12 for injecting fuel is provided in the throttle chamber 4. The fuel injected from the injector 12 is atomized in an air path of the throttle chamber 4 and mixed with the suction air to form a fuel-air mixture which is in turn supplied to a combustion chamber of the cylinder 8 through the suction pipe 6 when a suction valve 20 is opened. An air-fuel ratio sensor 11 is provided in the exhaust pipe 10 for detecting an air-fuel ratio of the gas in the exhaust pipe 10.

The throttle valve 14 is provided in the vicinity of the output of the injector 12. The throttle valve 14 is arranged so as to mechanically interlocked with an accelerator pedal (not shown) so as to be driven by the driver.

An air path 22 is provided at the upper stream of the throttle valve 14 of the throttle chamber 4 and an electrical heater 24 constituting a thermal air flow rate meter is provided in the air path 22 so as to derive from the heater 24 and electric signal which changes in accordance with the air flow velocity which is determined by the relation between the air flow velocity and the amount of heat transmission of the heater 24. Being provided in the air path 22, the heater 24 is protected from the high temperature gas generated in the period of back fire of the cylinder 8 as well as from the pollution by dust or the like in the suction air. The outlet of the air path 22 is opened in the vicinity of the narrowest portion of the venturi and the inlet of the same is opened at the upper stream of the venturi.

A throttle operating sensor (not shown in FIG. 1) is provided in the throttle valve 14 fo detecting the opening thereof and the detection signal fro the throttle opening sensor is taken into an analog-to-digital converter of a control circuit 64.

The fuel to be supplied to the injector 12 is first supplied to a fuel pressure regulator 38 from a fuel tank 30 through a fuel pump 32, a fuel damper 34, and a filter 36. Pressurized fuel is supplied from the fuel pressure regulator 38 to the injector 12 through a pipe 40 on one hand and fuel is returned on the other hand from the fuel pressure regulator 38 to the fuel tank 30 through a return pipe 42 so as to maintain constant the difference between the pressure in the suction pipe 6 into which fuel is injected from the injector 12 and the pressure of the fuel supplied to the injector 12.

The fuel air-mixture sucked through the suction valve 20 is compressed by a piston 50, burnt by a spark produced by an ignition plug 52, and the combustion is converted into kinetic energy. The cylinder 8 is cooled by cooling water 54, the temperature of the cooling water is measured by a water temperature sensor 56, and the measured value is utilized as an engine temperature. A high voltage is applied from an ignition coil 58 to the ignition plug 52 in agreement with the ignition timing.

A rotational signal detecting apparatus 5 for producing a reference angle signal at a regular interval of predetermined crank angles (for example 90 degrees) and a position signal at a regular interval of a predetermined unit crank angle (for example 1 degree) in accordance with the rotation of engine, is provided in a distributor 70, for example, in a manner that it is interconnected to a crank shaft or a cam shaft (not shown).

The output of the rotational signal detecting apparatus, the output of the water temperature sensor 56, and the electrical signal from the heater 24 are inputted into the control circuit 64 constituted by a microcomputer or the like so that the injector 12 and the ignition coil 58 are driven by the output of this control circuit 64.

Figure 2:
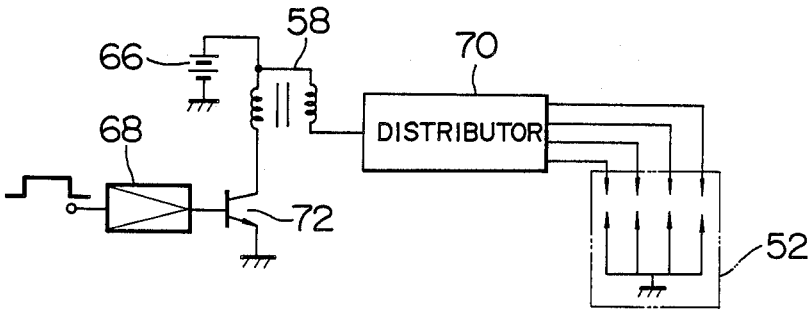
FIG. 2 shows an ignition system of the arrangement of FIG. 1.

In FIG. 2, which is an explanatory diagram of the ignition device of FIG. 1, a pulse current is supplied to a power transistor 72 through an amplifier 68 to energize this transistor 72 so that a primary coil pulse current flows into an ignition coil 58 from a battery 66. At the trailing edge of this pulse current, the transistor 72 is turned off so as to generate a high voltage at the secondary coil of the ignition coil 58.

This high voltage is distributed through a distributor 70 to ignition plugs 52 provided at the respective cylinders in the engine, in synchronism with the rotation of the engine.

Figure 3:
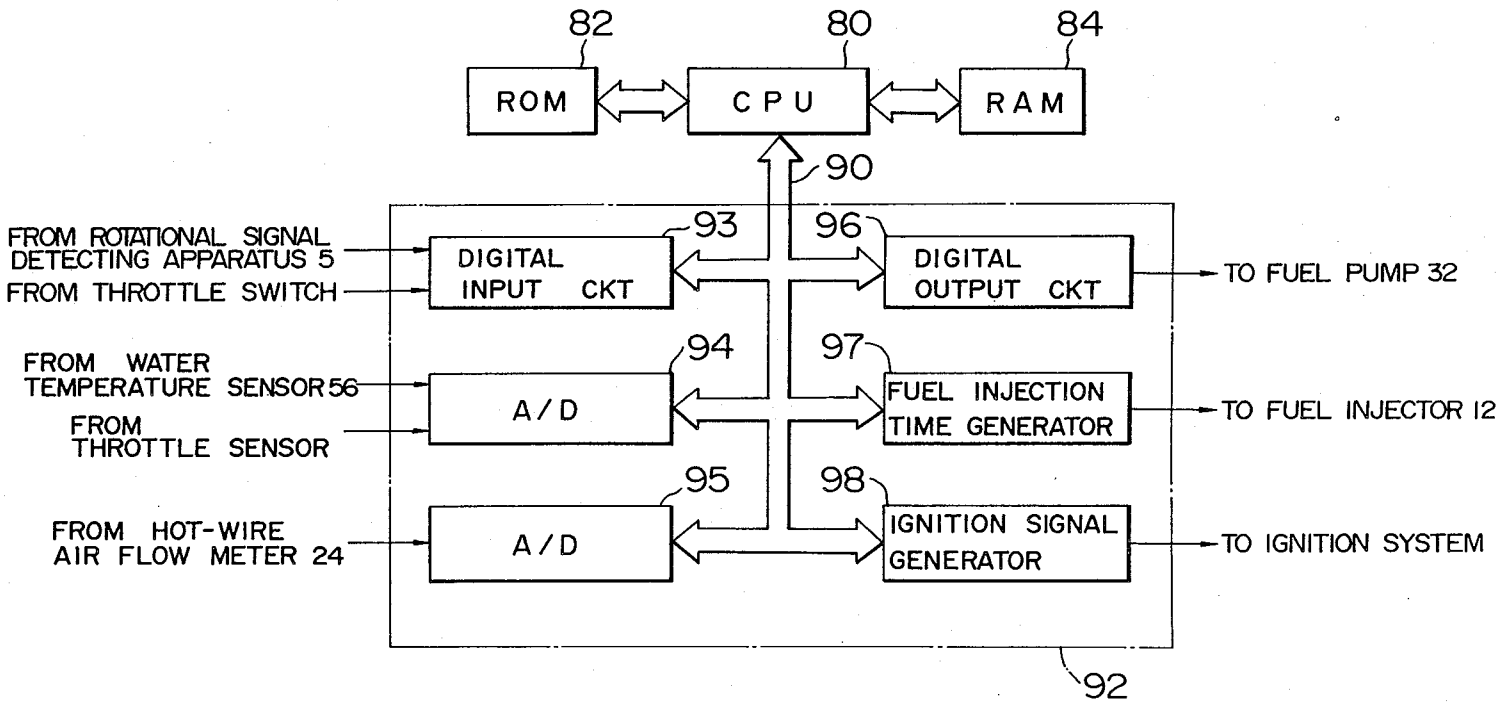
FIG. 3 is a block diagram showing the configuration of the control circuit of FIG. 1.

As shown in FIG. 3, the control circuit 64 has an input/output circuit 92, a CPU 80, a ROM 82 and a RAM 84 respectively connected via buses 86, 88 and 90. Output signals of the rotational signal detecting apparatus 5 and the throttle switch are led into a digital input circuit 93. Output signals of the water temperature sensor 56 and the throttle sensor are led into an A/D converter circuit 94. Further, the output signal of the hot-wire air flow meter 24 is led into an A/D converter circuit 95 for suction air flow. These signals are temporarily stored into the RAM 84 and then processed on the basis of a predetermined program stored in the CPU.

That is to say, the CPU 80 calculates the fuel pump control data, fuel injection time and ignition timing on the basis of the above described input signals. The data thus calculated are supplied to a digital output circuit 96, a fuel injection time generator circuit 97 and an ignition signal generator circuit 98 to control the fuel pump 32, the fuel injector 12 and the ignition system (FIG. 2), respectively.

Figure 4:
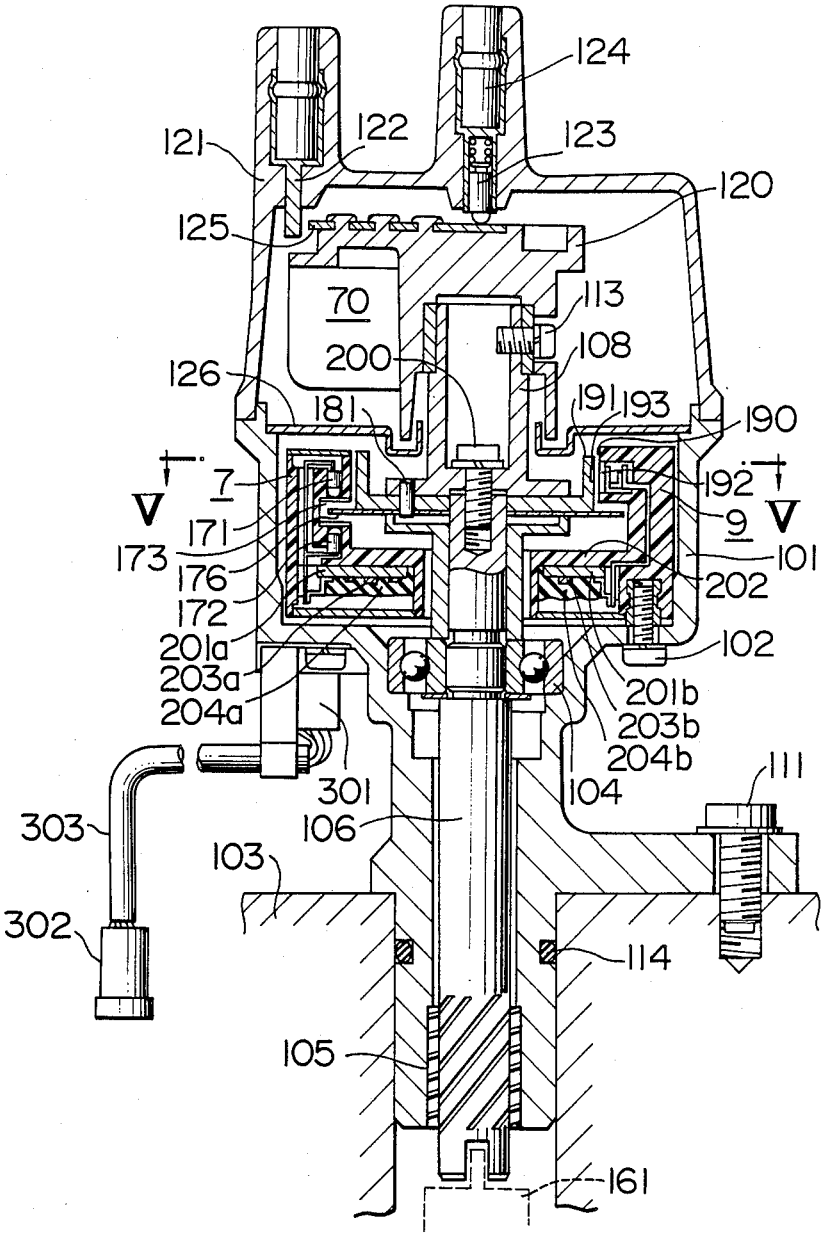
FIG. 4 is a vertical sectional diagram of an embodiment in which the rotational signal detecting apparatus according to the present invention is contained in a distributor for internal combustion engine.
Figure 5:
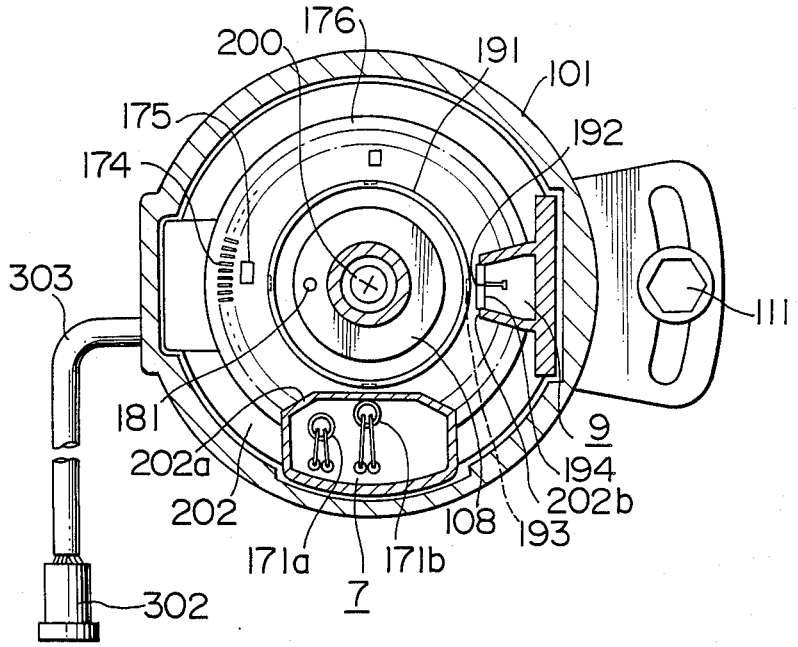
FIG. 5 is a sectional view seen along a line V-V of FIG. 4.
Figure 6:
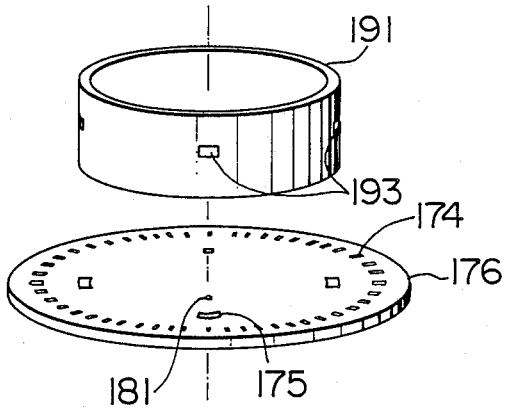
FIG. 6 is an oblique view of a magnetized drum and a rotor plate shown in FIG. 4.

FIG. 4 is a vertical sectional diagram of an embodiment in which the rotational signal detecting apparatus according to the present invention is contained in a distributor 70 for internal combustion engine. FIG. 5 is a sectional view seen along a line V—V of FIG. 4. FIG. 6 is an oblique view of a rotor plate and a magnetized drum.

The configuration of the rotational signal detecting apparatus will now be described by referring to FIGS. 4 to 6.

A cup-shaped housing 101 made by aluminum die casting and forming the main body of a distributor 70 is attached to the main body 103 of the internal combustion engine by a bolt 111. Between the housing 101 and the engine main body 103, an O ring 114 is disposed to prevent the oil within the engine from flowing out. Bearing 104 and bearing 105 are disposed on the housing 101 to support a shaft 106. One end of the shaft 106 is coupled to a drive shaft 161 rotating in synchronism with the crankshaft or the cam shaft. One end of a rotor shaft 108 is fitted to the other end of the shaft 106. As shown in FIG. 5, a thin disk-shaped rotor plate 176 having a plurality of slits 174 and 175 is fitted to the other end of the shaft 106. The slits 174 are arranged on the rotor plate 176 at a predetermined angle interval, say, 1° in the circumferential direction. Inside the slits 174, the slits 175 are arranged at a predetermined angle interval, say, 90° in the circumferential direction.

It is now assumed that the shaft 106 rotates by 360° each time the crankshaft rotates by 360°, for example. One of the slits 175 is longer than the remaining three slits in the circumferential direction. In the peripheral portion of a cylindrical magnetized drum 191, magnetized portions 193 are disposed at an interval of, say, 90° in the circumferential direction. The magnetized drum 191 is fitted to the other end of the shaft 106.

The rotor shaft 108, the magnetized drum 191 and the rotor plate 176 have respective through-holes through which one positioning pin 181 is commonly inserted. The rotor plate 176 and the magnetized drum 191 are disposed at a predetermined angular position with respect to the shaft 106, i.e., with respect to the crank axis. The rotor shaft 108, the magnetized drum 191 and the rotary plate 176 are fastened to the other end of the shaft 106 by a screw 200 to be rotated together with the shaft 106.

A resin mold case 202 is fixed within the housing 101 by means of a screw 102. A photoelectric pickup 7, an electromagnetic pickup 9 and their waveform shaping circuit 201 (excepting the magnetized drum 191 and the rotor plate 176) are fixed to a projection portion 202*a* of the mold case 202.

The photoelectric pickup has light emitting devices such as light emitting diodes 171, light receiving devices such as light receiving diodes 172, and the rotor plate 176. The light emitting diodes 171 and the light receiving diodes 172 are so disposed as to face to each other via the plate 176. The light emitting diodes 171 comprise two light emitting diodes 171*a* and 171*b*, for example. The light receiving diodes 172 also comprise two light receiving diodes 172*a* and 172*b*. The light emitting diode 171*a* and the light receiving diode 172*a* are arranged to face to each other via the slit 174. The light emitting diode 171*b* and the light receiving diode 172*b* are arranged to face each other via the slit 175. The light emitting diodes and the light receiving diodes are so embedded in the projection portion 202*a* of the mold case 202 as to expose the light emitting portion and the light receiving portion.

The outputs of the light receiving diodes 172*a* and 172*b* are supplied to a waveform shaping circuit 201*a*. The waveform shaping circuit 201*a* is composed of printed resistors and a monolithic IC 203*a*, covered by insulator gel 204*a*, and integrally fixed to a mold case 202. The light emitting diodes 171 are supplied with power from the control circuit 64 via power feeders of wire harness. And the output of the waveform shaping circuit 201*a* is sent to the control circuit via wire harness 303. Numeral 302 denotes a coupler for connecting the wire harness 303 to the wire harness of the control circuit 64 side.

Each of the light receiving diodes 172*a* and 172*b* may be constituted by two light receiving diodes connected in parallel. In this case, the output value of the photoelectric pickup is increased to twice.

The electromagnetic pickup 9 is composed of the magnetized drum 191 and a magnetoresistive device 192, for example. The magnetoresistive device 192 is so disposed in a projection portion 202*b* of the mold case 202 as to face the magnetized portion 193 disposed on the periphery of the magnetizing drum 191 with a predetermined distance.

Figure 7A:
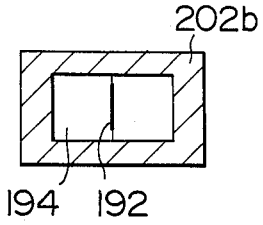
FIGS. 7A to 7C show examples of arrangement of magnetoresistive devices of the magnetic pickup.
Figure 7B:
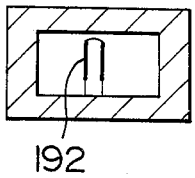

As shown in FIG. 7*a*, for example, the magnetoresistive device 192 may be one permalloy line formed by evaporating permalloy, for example, on a glass plate 194 attached to a projection portion 202*b* of a mold case 202. This permalloy line is supplied with direct current voltage V from the control circuit 64 via wire harness 303. The magnetoresistive device 192 may comprise a plurality of permalloy lines connected in series as shown in FIG. 7B.

The terminal voltage of the magnetoresistive device 192 varies whenever the magnetoresistive device faces the magnetized portion due to the rotation of the magnetized drum 191. And the terminal voltage of the magnetoresistive device 192 is supplied to the control circuit 64 via the waveform shaping circuit 201*b* and wire harness.

In the same way as the circuit 201*a*, a waveform shaping circuit 201*b* is composed of printed resistors and a monolithic IC 203*b* formed on the ceramics substrate, covered by insulator gel 204*b*, and integrally fixed to the mold case 202.

In an alternative magnetic pickup, a reluctor having a plurality of projections is fixed on the circumferential portion of the other end of the shaft 106 instead of the magnetized drum 191, and an electromagnetic pickup coil is fixed on the projection portion 202*b* of the mold case 202 instead of the magnetoresistive device so as to produce the pulse signal in the pickup coil in synchronism with the rotation of the shaft 106. In this case, reluctors are disposed at an interval of 90°, and one reluctor is made larger than remaining three reluctors in width of circumferential direction.

A distribution rotor 120 is fixed to the other end of the rotor shaft 108 by means of a screw 113. A cap 121 is so coupled to an opening portion of the housing 101 as to cover the distribution rotor 120. A rotor head electrode 125 of the distributor 120 is electrically connected to a side electrode 122 via a gap. Numeral 123 denotes a carbon point disposed for conduction between the rotor head electrode 125 and a center terminal 124. The center terminal 124 receives the secondary output voltage of the ignition coil, and the rotor head electrode 125 distributes the secondary output voltage of the ignition coil. Accordingly, the output of the distributor rotor is supplied to the ignition plug 52 via the rotor head electrode 125, the carbon point 123 and the center terminal 124. A shield disk 126 prevents the discharge noise from the distributor from being supplied to the waveform shaping circuit.

How to construct the apparatus shown in FIG. 4 will now be briefly described.

At first, the housing 101 is fixed to the main body of the engine by using a bolt 111, and the shaft is supported by the bearings 104 and 105. Subsequently, the mold case 202 having therein the light emitting diode 171, the light receiving diode 172, the magnetoresistive device 192, the waveform shaping circuits 201*a* and 201*b* and the insulator gel 204*a* and 204*b* are fixed to the housing 101 by means of a screw 102. The rotor plate 176, the magnetizing drum 191 and the rotor shaft 108 are integrally positioned by the positioning pin 181 and fixed to the other end portion of the shaft by the screw 200. Subsequently, the distribution rotor 120 is fixed to the other end portion of the rotor shaft 108 by means of the screw 113 and covered by the cap 121.

Figure 8A:
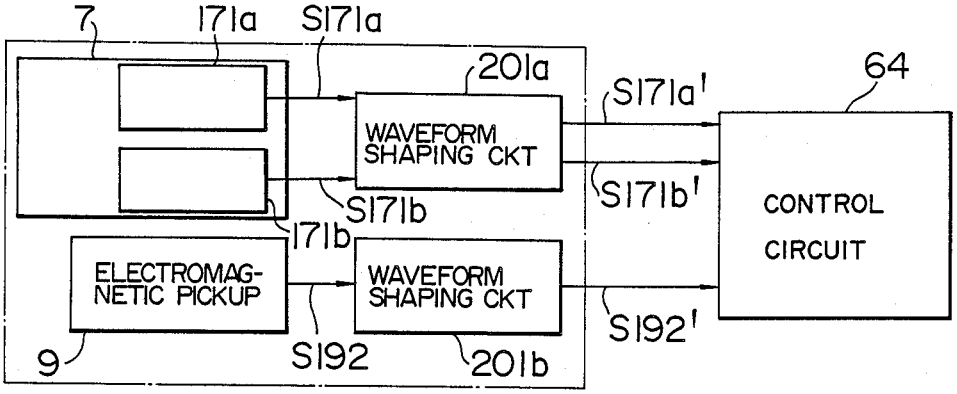
FIGS. 8A and 8B are block diagrams of embodiments of the present invention.
Figure 9:
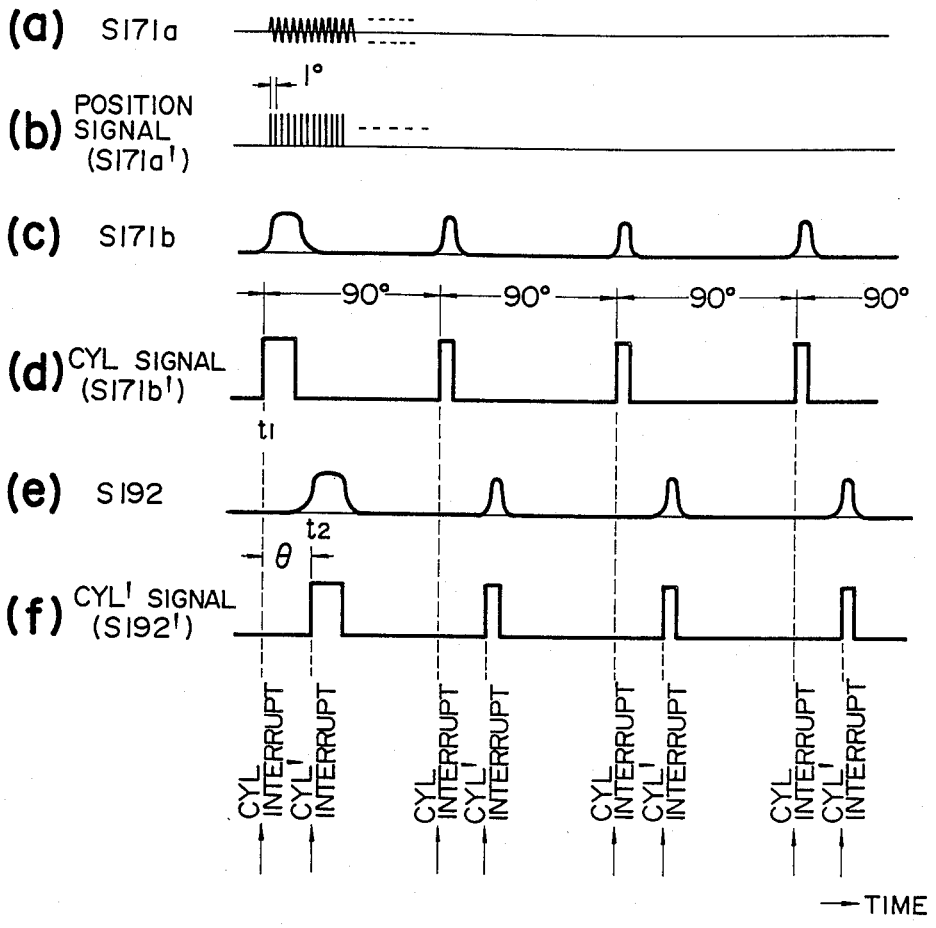
FIG. 9 is a time chart showing signal waveforms appearing at various parts of FIGS. 8A and 8B.

The operation of this embodiment configured as described above will no be described by referring to FIGS. 8A and 9, FIG. 8A is a block diagram of this embodiment. FIG. 9 is a signal waveform diagram of this embodiment. In this embodiment, the output of the photoelectric pickup is normally used as the rotation detecting signal. Should the photoelectric pickup fail, the electromagnetic pickup is used as the backup sensor instead.

Rotation of the crankshaft of the engine is transmitted to the shaft 106 via the drive shaft 161 rotating in synchronism with the crankshaft. Accordingly, the rotor shaft 176 and the magnetic drum 191 rotate in synchronism with the crankshaft. Depending upon the rotation of the shaft 106, the quantity of light applied to the light receiving diodes 172*a* and 172*b* as well as the magnetic field applied to the magnetoresistive device 192 vary in synchronism with the rotation of the crankshaft. The outputs of the light receiving diodes and the magnetoresistive device undergo waveform shaping in the waveform shaping circuits 201*a* and 201*b*, respectively. The resultant digital signals are sent to the control circuit 64 as the number of crank rotations and the crank position signal. On the basis of these signals supplied from the waveform shaping circuits 201*a* and 201*b* as well as other signals such as suction air flow, the control circuit 11 sends control signals to the fuel injector 12, the ignition device and so on.

The slits 174 are disposed at an interval of 1°. Assuming that the engine of this embodiment has four cylinders, the slits 175 are disposed at an interval of 90°. Only one of four slits 175 is made wider than remaining three slits in width of circumferential direction. On the other hand, the magnetized drum 191 has magnetized portions at an interval of 90°. One magnetized portion is made wider than remaining three magnetized portions in magnetized width of circumferential direction.

As shown in FIG. 9, the output signal S171*a* ((a) of FIG. 9) of the light receiving diode 171*a* is passed through the waveform shaping circuit 201*a*. The resultant signal 171*a*' is a pulse signal sent out each time the crankshaft rotates by 1° as shown in (b) of FIG. 9 and a pulse signal corresponding to the above described position signal. The output signal S171*b* ((c) of FIG. 9) of the light receiving diode 171*b* is passed through the waveform shaping circuit 201*b*. The resultant signal S171*b*' is a pulse signal (hereafter referred to as CYL signal) sent out each time the crankshaft rotates by 90° as shown in (d) of FIG. 9. The CYL signal corresponds to the above described reference angle signal and is composed of four consecutive pulses CYLa, CYLb, CYLc and CYLd. The pulse CYLa has a pulse width wider than that of remaining three pulses and is sent out at a predetermined angular position of the crankshaft.

By detecting the pulse width of each pulse of the CYL signal on the basis of the position signal, therefore, the CYLa signal is distinguished from the remaining three pulses CYLb, CYLc and CYLd. On the basis of the distinguished CYLa signal, the cylinder number is determined.

On the other hand, the output signal S192 ((e) of FIG. 9) of the magnetoresistive device 192 of the magnetic pickup is passed through the waveform shaping circuit 201*b*. As shown in (f) of FIG. 9, the resultant signal S192' is a pulse signal (hereafter referred to as CYL' signal) sent out each time the crankshaft rotates by 90° in the same way as the CYL signal. In the same way as the CYL signal, the CYL' signal is composed of four consecutive pulses CYLa' CYLb', CYLc' and CYLd'. The pulse CYLa' is larger in width than remaining three pulses. Thus, on the basis of the position signal, the pulse CYLa' is distinguished from other three CYL' pulses to distinguish the cylinder number. This is because the CYLa' signal is delivered when one of the four pistons of the four cylinders reaches at a given crank angular position.

Should any one of the three signals, i.e., the position signal, the CYL signal and the CYL' signal fail, the faulty signal can be easily detected by comparing the three signals each other.

When the three signals are normal in this embodiment, the engine is controlled on the basis of the output signal of the photoelectric pickup, i.e., the position signal and the CYL signal. Should the CYL signal fail, the engine is controlled on the basis of the output signal of the electromagnetic pickup, i.e., the CYL' signal instead of the CYL output signal. As shown in FIG. 9, the phase of the CYL' signal is delayed by $\theta$ as compared with that of the CYL signal. In response to rising edges of the CYL signal and CYL' signal, the CYL interrupt and the CYL' interrupt are generated, respectively.

For counting the position signals generated respectively between the CYL interrupts and the CYL' interrupts, a CYL counter and a CYL' counter are disposed.

If the CYL interrupt and CYL40 interrupt are generated at normal timing, i.e., if the CYL signal and the CYL' signal are outputted normally, 90 position pulses can be counted between respective signals.

By checking the counted values in the CYL counter and the CYL' counter at each CYL interrupt and each CYL' interrupt, therefore, it can be determined whether the CYL signal and the CYL' signal are normal or not. Unless the value of the CYL counter is equal to 90, therefore, it is determined that the CYL signal is faulty. Then the CYL' signal is used instead of the CYL signal, and the engine is controlled in response to the CYL' interrupt.

Assuming now that the value of the CYL counter is read out in response to the CYL interrupt at time $t_1$ in FIG. 9 and the CYL signal is determined to be faulty on the basis of the value thus read out, therefore, the engine is controlled in response to the CYL' interrupt generated at time $t_2$ instead of the CYL interrupt.

The phase difference 8 between the CYL signal and the CYL' signal is so defined that the CYL signal may be determined on the basis of the value read out of the CYL counter and the occurrence of the CYL' interrupt may be detected.

Figure 10A:
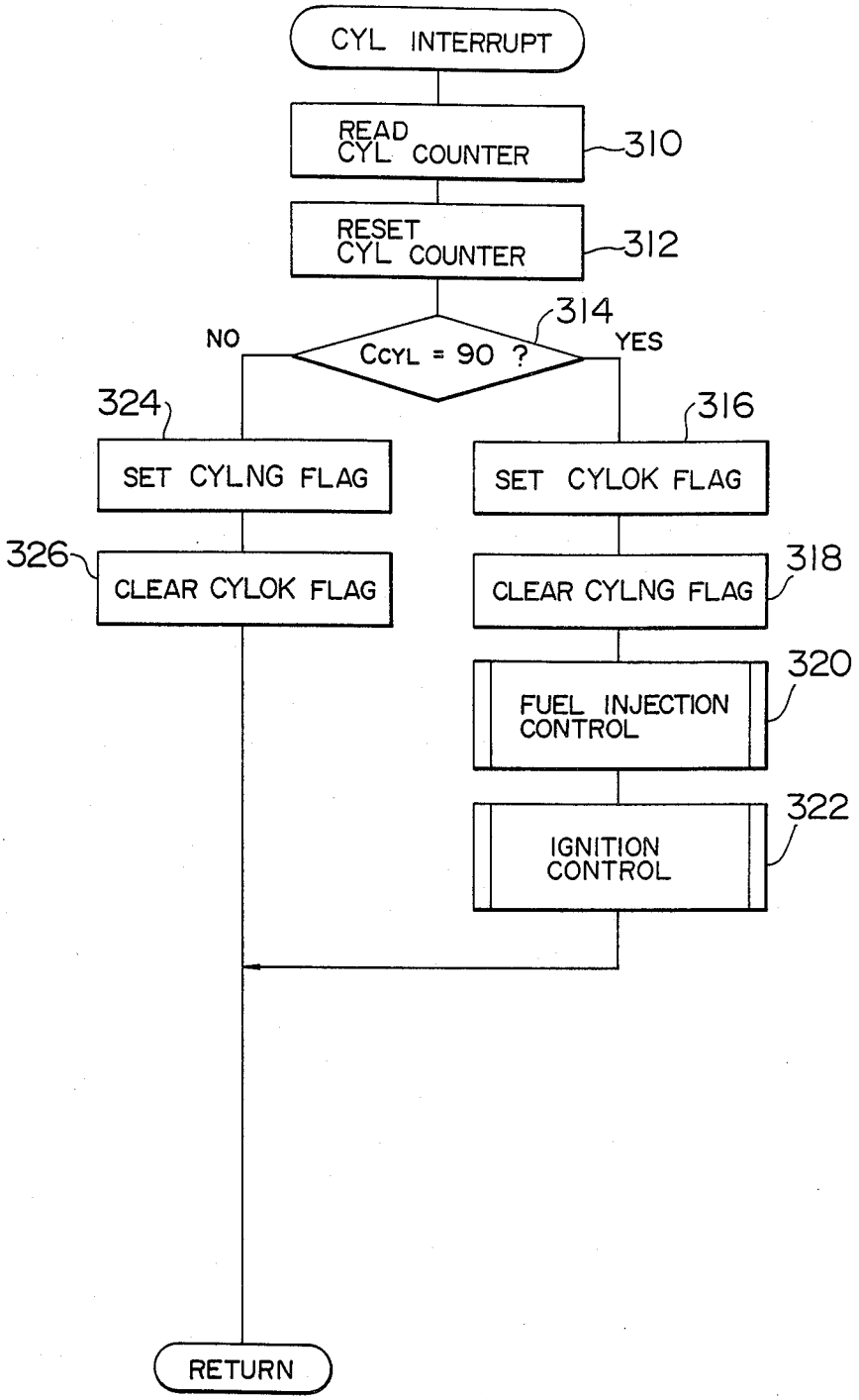
FIGS. 10A and 10B are flow charts showing the control operation effected when the engine is controlled on the basis of the output signal of the embodiment illustrated in FIG. 4.
Figure 10B:
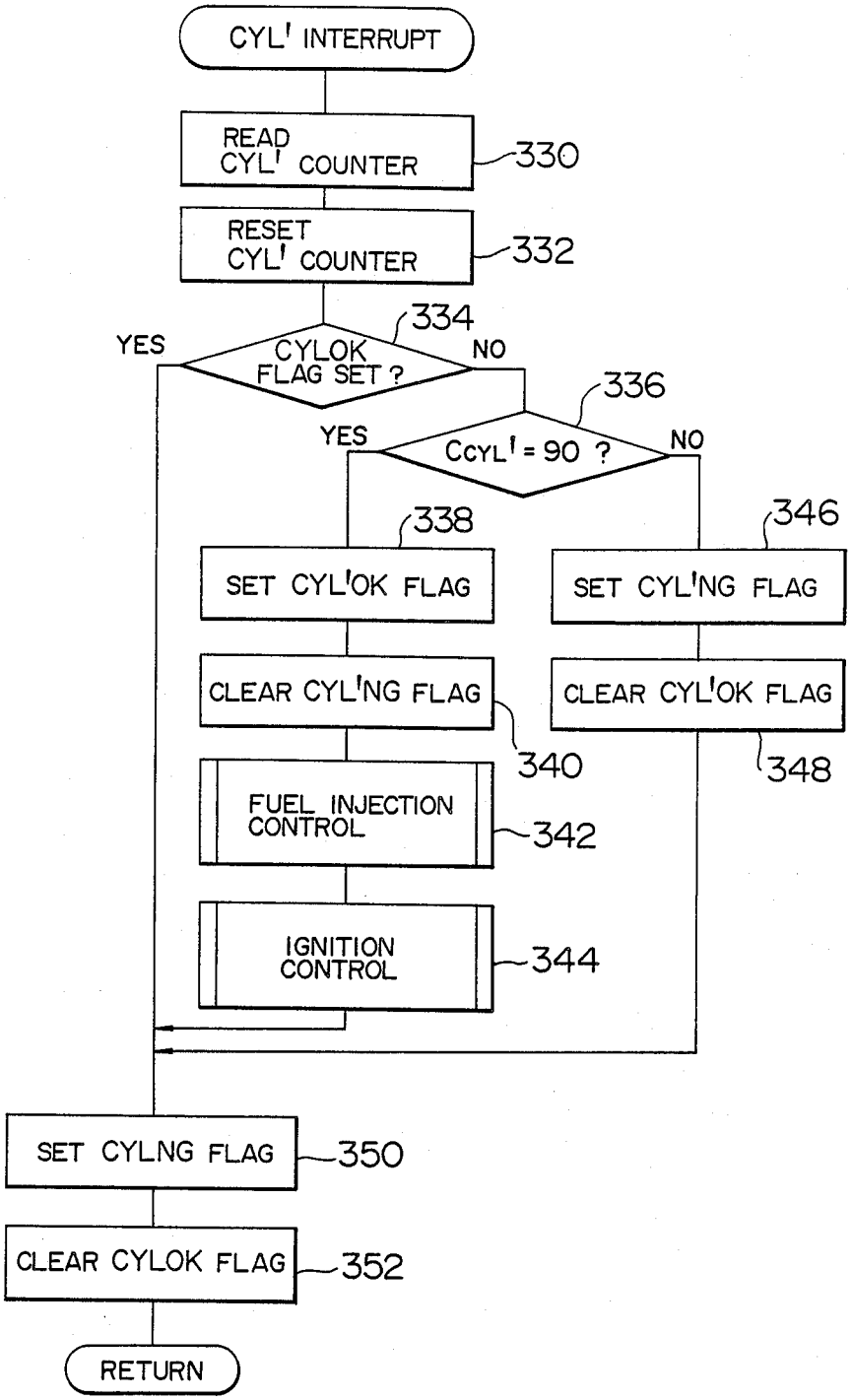

FIGS. 10A and 10B are flow charts for describing the operation effected when the engine is controlled on the basis of the CYL signal and CYL' signal in the present embodiment.

Steps of the flow chart shown in FIGS. 10A and 10B are executed by the CPU 80 in the control circuit 6 on the basis of the program stored in the ROM 82.

At first, the flow chart of FIG. 10A will now be described. When the CYL signal is inputted to the control circuit 64, it is interpreted as the occurrence of the CYL interrupt. In response to the rising edge of the CYL interrupt, the flow of FIG. 10A is carried out. The value $C_{CYL}$ of the CYL counter is read at step 310. The CYL counter and the CYL' counter may be disposed in the input/output circuit 92 of the control circuit 64 as hardware means or may be disposed in the RAM 84 as a software counter. Succeedingly, the CYL counter is reset at step 312. It is checked at step 314 whether the value $C_{CYL}$ read at step 310 is equal to 90 or not. If the value $C_{CYL}$ is 90, it is determined that the CYL signal is normal and the CYLOK flag is set in the RAM 84 at step 316. The CYLNG flag in the RAM is then cleared at step 318. The CYLOK flag and the CYLNG flag are set respectively when the CYL signal is determined to be normal and abnormal.

On the basis of the CYL interrupt, a subroutine for setting the fuel injection timing and the amount of fuel injection is started at step 320. And a subroutine for setting the ignition timing and the conduction timing of the primary current in the ignition coil is started at step 322. In these subroutines, therefore, the fuel injector, the ignition device and so on are controlled on the basis of the CYL signal, the position signal and the output data of various sensors.

If it is judged at step 314 that the value $C_{CYL}$ is not equal to 90, it is determined that the photoelectric pickup is faulty. Subsequently, the CYLNG flag is set at step 324 and the CYLOK flag is reset at step 326.

The flow chart of FIG. 10B will now be described.

If the CYL' signal is inputted to the control circuit 64, it is determined in response to the rising edge of the CYL' signal that the CYL' interrupt has occurred and the flow of FIG. 10B is executed. At first, the value $C_{CYL'}$ of the CYL' counter is read at step 330 and the CYL' counter is reset at step 332.

It is checked at step 334 whether the CYLOK flag has already been set in the RAM or not, i.e., whether the CYL signal is normal or not. If the CYLOK flag has already been set, the CYL signal is normal, and hence the CYLNG flag is set at step 350, and the CYLOK flag is reset at step 352. If the CYL signal is determined to be normal in the flow of FIG. 10B, the CYLNG flag and the CYLOK flag respectively set and reset at steps 350 and 352 are reset and set, respectively.

If it is determined at step 334 that the CYLOK flag has already been reset, the CYL signal is faulty and the flow advances to step 336. It is checked at step 336 whether the counted value $C_{CYL'}$ of the CYL' step 330 is equal to 90 or not to determine whether the CYL' signal is normal or not.

Unless the value $C_{CYL'}$ is 90, the CYL' signal is determined to be faulty. Thereafter, the CYL'NG flag is set at step 346 and the CYL'OK flag is cleared at step 348. Further, steps 350 and 352 are executed.

If the value $C_{CYL'}$ is 90, the CYL' signal is determined to be normal. In this case, the CYL'OK flag is set at step 338 and the CYL'NG flag is cleared at step 340.

On the basis of the CYL' signal and the position signal, the fuel injection control and the ignition control are effected at steps 342 and 344. Thereafter, steps 350 and 352 are executed.

In the present embodiment described above, the CYL' signal is used as the backup for the CYL signal. Since the probability that the CYL signal and the CYL' signal become faulty at the same time is equal to the product of probabilities that respective signals become faulty, the reliability of the rotational signal detecting apparatus is significantly improved.

It is also possible to display whether the CYL signal and CYL' signal are normal or not on the basis of flags CYLOK, CYLNG, CYL'OK and CYL'NG.

Figure 11:
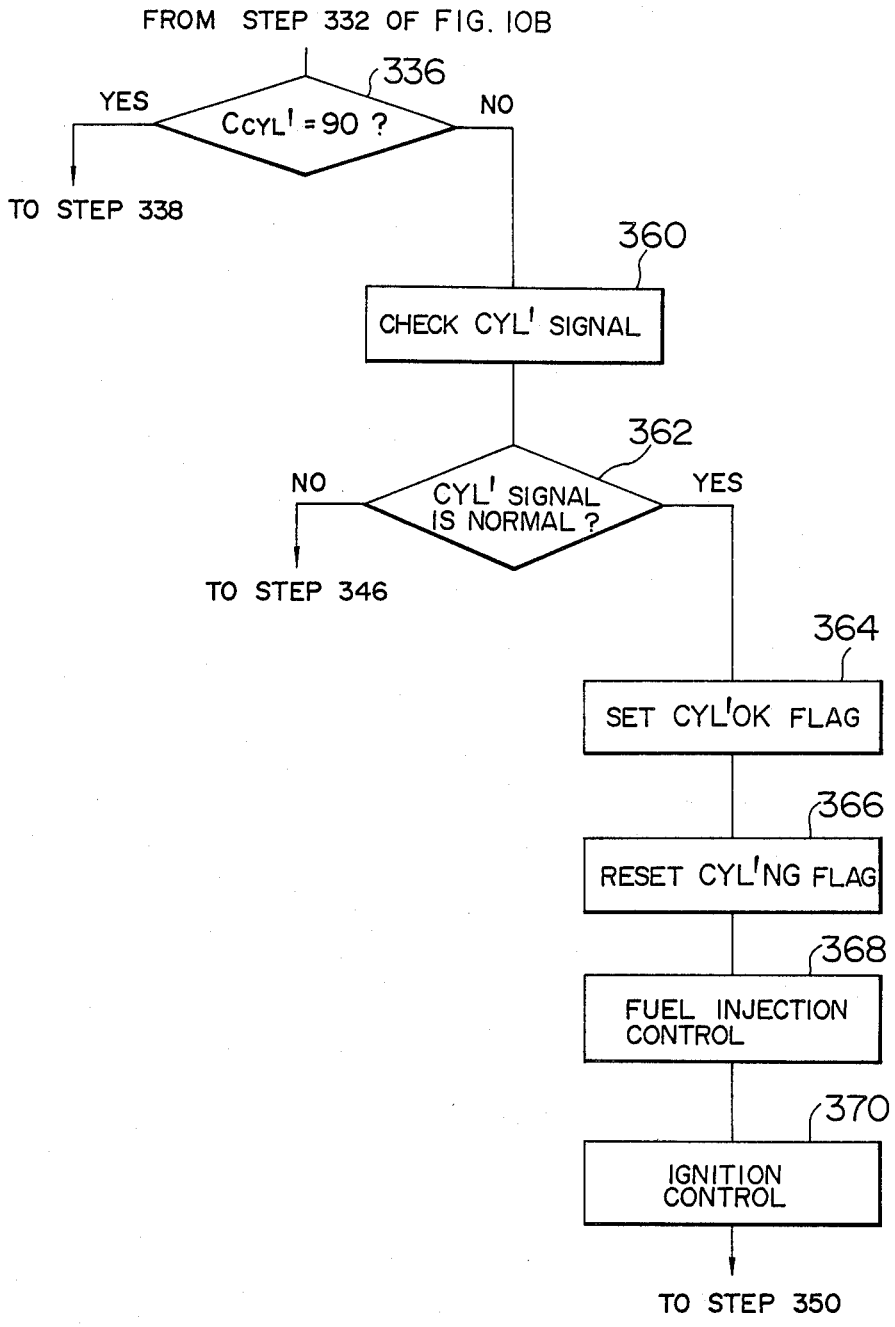
FIG. 11 is a flow chart showing another control example effected when the engine is controlled on the basis of the output signal of the embodiment illustrated in FIG. 4.

In the above description of the flow of FIGS. 10A and 10B, the CYL' signal is used as the backup for the CYL signal when the CYL signal becomes faulty. The engine control method used when the position signal becomes faulty will now be described with reference to the flow chart of FIG. 11. The control flow in this case is the same for FIG. 10A. For FIG. 10B, the flow shown in FIG. 11 is added to FIG. 10B.

If the position signal becomes faulty, the value $C_{CYL}$ of the counter CYL is not equal to 90 at step 314 in FIG. 10A, and steps 324 and 326 are then executed.

On the other hand, the value $C_{CYL'}$ CYL' is not equal to 90 at step 336 in FIG. 10B as well and the flow advances to step 360.

It is checked at step 360 whether the CYL' signal is normal or not. That is to say, a software time counter for counting clocks is provided in the RAM 84, for example. The software timer counter is reset in response to the CYL' signal. In response to the CYL' signal, the value in the counter at the time of reset is read out to measure the repetition period of the CYL' signal. Thus the contents of the software timer counter are read out at step 360.

Succeedingly, it is checked at step 362 whether the value $C_{CYL'}$ read out of the software timer counter does not exceed a predetermined value or not. If the value read out does not exceed the predetermined value, the CYL' signal is determined to be normal, and the flow advances to step 364. In this case, the position signal is determined to be faulty.

If the value $C_{CYL'}$ exceeds the predetermined value, the CYL' signal is determined to be faulty, and the flow advances to step 346.

The CYL'OK flag is set at step 364 and the CYL'NG flag is reset at step 366. At steps 368 and 370, the fuel injection control and ignition control are effected on the basis of only the CYL' signal. Thereafter, steps 350 and 352 are executed. Even if the engine is controlled on the basis of only the CYL' signal, the car travels without hindrance.

In emergency, the minimum necessary engine control can be conducted even when the CYL' signal is not a pulse signal generated each time the crackshaft rotates by 90° but a pulse signal generated each time the crankshaft rotates by 360°. In the embodiment of FIGS. 4 to 6, therefore, one magnetized portion of the magnetized drum 191 may be so disposed on the magnetized drum as to be positioned with respect to the crankshaft at a predetermined angular position.

Figure 7C:
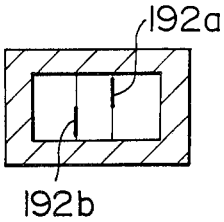

Although in the embodiment of FIGS. 4 to 6 the electromagnetic pickup used as the backup is configured to output only the CYL' signal, it may be configured to output the position signal as well. In this case, two devices **192*a* and 192*b* are disposed as the magnetoresistive device 192 of the electromagnetic pickup as shown in FIG. 7C. And one device 192*a* detects the CYL' signal and the other device 192*b* detects the position signal. In addition to the magnetized portion 193 disposed on the magnetized drum 191 at an interval of 90°, therefore, the magnetized drum 191 is so provided with magnetized portion 193' at an interval of 1° in the circumferential direction of the magnetized drum 191 as to face the device 192*b***.

The operation flow of the engine control effected by the rotational signal detecting apparatus thus configured is the same as that of FIGS. 10A and 10B excepting the points described below. That is to say, the CYL' counter does not count the position signals of the photoelectric pickup, but count the position signals of the electromagnetic pickup. Further, the fuel injection control and the ignition control are effected at steps 342 and 344 of FIG. 10B on the basis of the position signal and the CYL' signal supplied from the electromagnetic pickup.

Even if in this case there is an abnormality in the CYL signal and/or the position signal supplied from the photoelectric pickup, the usual engine control can be effected in response to the CYL' interrupt on the basis of the CYL' signal and the position signal supplied from the electromagnetic pickup.

In the above described embodiment, the electromagnetic pickup is used as the backup for the photoelectric pickup, resulting in merits described below. The photoelectric pickup 7 and the electromagnetic pickup 9 detect the rotational signal by using the light and the magnetic field as media, respectively. In principle, the light and the magnetic field do not affect each other. Even if the pickups 7 and 9 are disposed close together, therefore, the detection precision of the rotational signal is no deteriorated. In the embodiment of FIGS. 4 to 6, therefore, the detection precision is not deteriorated, and the electromagnetic pickup 9 can be disposed in a dead space produced when only the photoelectric pickup 7 is contained in the distributor. Accordingly, addition of the electromagnetic pickup 9 as the backup sensor does not affect the size of the entire distributor at all. That is to say, the size of the entire distributor can be reduced as compared with the distributor having two systems of electromagnetic pickups.

Further, the electromagnetic pickup is used as the backup for the photoelectric pickup. Even if the rotational signal cannot be detected by the photoelectric pickup because of the change caused with elapse of time in the light emitting face of the light emitting device and in the light receiving face of the light receiving device, such a change with time is not caused in the electromagnetic pickup and hence the rotation signal can be properly detected.

Further, it is also possible to use a photoelectric pickup as the backup for the electromagnetic pickup. This modification provides effects similar to those obtained when the electromagnetic pickup is used as the backup and is effective in the case described below. In an electromagnetic pickup, a plurality of magnetoresistive devices are generally connected in series as shown in FIG. 7B to produce a rotational signal having a large output value. Accordingly, the electromagnetic pickup is generally used as the rotational signal detecting apparatus. If another electromagnetic pickup is used as the backup for the above described electromagnetic pickup and the space for housing these two electromagnetic pickups is limited, the magnetic fields interfere each other, resulting in the deteriorated precision of the rotational signal. Especially when the rotational signal detecting apparatus is disposed in a distributor of a car, for example, there occurs a problem that the magnetic fields of the two magnetic pickups interfere each other because the space for housing the detecting apparatus is narrow. In this case, therefore, it is desirable to use an electromagnetic pickup as the rotational signal detecting apparatus under the normal condition and use a photoelectric pickup as the backup. Thereby, it is possible to prevent the interference between two pickups without deteriorating the detection precision.

In accordance with the present invention, the rotor plate 176 of the photoelectric pickup 7 and the magnetized drum 191 of the electromagnetic pickup 9 are integrally constructed by means of the positioning pin 181. Accordingly, the phase difference between the output signals of the photoelectric pickup 7 and the electromagnetic picku 9 is defined by the fabrication precision of these components 171, 191 and 181 and is not affected by the adjustment work effected when these components are mounted. Therefore, the phase difference between the CYL signal and the CYL′ signal as shown in FIG. 9 is extremely accurately kept at $\theta$ with little difference between products. As a result, high detection precision of the rotational signal is maintained.

Further, mounting of the light emitting device and the light receiving device of the photoelectric pickup 7 as well as the magnetoresistive device 192 and the waveform shaping circuit of the electromagnetic pickup 9 can be completed once by attaching the resin mold case to the housing 101, resulting in fine work efficiency and precision.

In the above described embodiment, a combination of the magnetized drum and the magnetoresistive device are used in the electromagnetic pickup. However, a similar effect can be obtained by using a combination of the reluctor, a stator, a pickup coil and a magnetic, integrating the reluctor with the shaft 106 as one body, integrating the pickup coil including the stator with the mold case, and suitably setting the magnetic circuit.

Figure 8B:
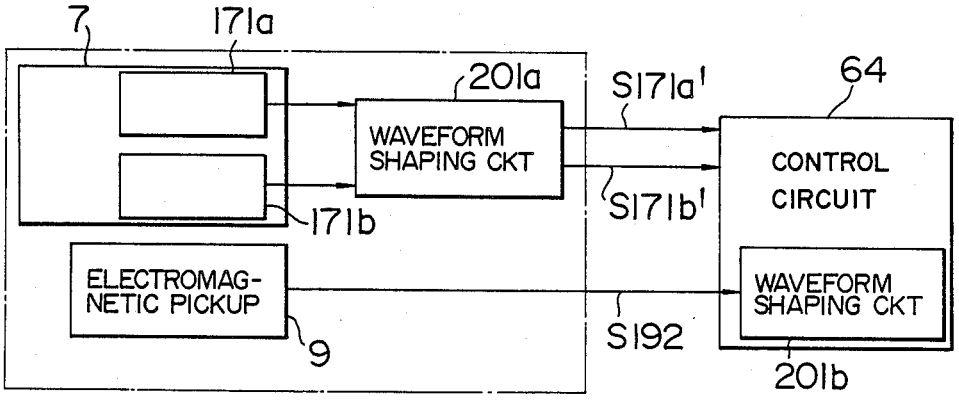

When the output signals of the photoelectric pickup and the electromagnetic pickup as shown in (a), (c) and (e) of FIG. 9 are small in magnitude, these output signal waveforms tend to be affected by noises generated from the distributor, for example. In the embodiment of FIG. 4, therefore, the waveform shaping circuits 201*a* and 201*b* are disposed in the housing 101 as shown in FIG. 8A, and the signals which have undergone the waveform shaping are taken out from the housing 101. When the output signals of the electromagnetic pickup are large in magnitude, for example, however, they are not susceptible to the influence of the noise. As shown in FIG. 8B, therefore, the waveform shaping circuit 201*b* may be disposed within the control circuit 64.

In the above described embodiment, the magnetoresistive device of the electromagnetic pickup and the light emitting device, the light receiving device and the waveform shaping circuit of the photoelectric pickup are integrally disposed on the same casing, and the casing is fixed to the housing 101. As a result, a plurality of pickups can be attached to the housing by effecting the mounting work only a single time. Further, the magnetized drum of the electromagnetic pickup and the rotor plate and the rotor shaft 108 of the photoelectric pickup are positioned by the positioning pin and integrally attached to the shaft 106 as one body. Accordingly, the assembly time can be reduced and the productivity can be improved.

In the rotational signal detecting apparatus according to the present invention, the electromagnetic pickup and the photoelectric pickup are used. Because they do not interfere with each other, their arrangement is not limited and they can be arranged close together without causing any problem. Even if the rotational signal detecting apparatus is disposed within the distributor as in the above described embodiment, therefore, the rotational signal detecting apparatus can be disposed in a small space within the distributor nearly on the same plane. Accordingly, the length of the distributor projecting from the engine, i.e., the length of the shaft 106 in the rotation axis direction can be reduced. Thus the centroid of the distributor can be disposed near the main body of the engine to improve the resistance against vibration. As a result, it is possible to provide a highly reliable rotational signal detecting apparatus.

Further, the rotor plate of the photoelectric pickup and the magnetized drum of the electromagnetic pickup are integrally assembled with the rotor shaft 108 as one body. The light emitting device and the light receiving device of the photoelectric pickup and the magnetoresistive device of the electromagnetic pickup are integrally assembled to the mold case 202. Accordingly, the phase adjusting work between the photoelectric pickup and the electromagnetic pickup during assembly becomes unnecessary. As a result, a detecting apparatus with high precision is obtained.

In a rotational signal detecting apparatus according to the present invention, the electromagnetic pickup and the photoelectric pickup may be disposed on different planes perpendicular to the rotation axis of the shaft 106, without being constrained to the embodiment of FIGS. 4 and 5. Now, other types of conventional photoelectric pickups may be used instead of the photoelectric pickup shown in FIGS. 4 and 5.

By using the magnetoresistive device, for example, in the electromagnetic pickup and using a combination of the light receiving diode and the light emitting diode, for example, in the photoelectric pickup, the present invention facilitiates the production of a small-sized device having high resolution. In particular, a small-sized rotational signal detecting apparatus having high precision is obtained.

By using one of the output signal of the electromagnetic pickup and the output signal of the photoelectric pickup as the backup for the other output signal, the present invention provides a rotational signal detecting apparatus having backup function which is free from the drawbacks of the prior art.

I claim:

1. A rotational signal detecting apparatus comprising:

a housing;

a rotor shaft attached to said housing so as to be freely rotatable, said rotor shaft rotating in synchronism with a crankshaft or a cam shaft of an engine;

a photoelectric pickup comprising a first rotating portion fixed to said rotor shaft so as to rotate with said rotor shaft as one body, a first fixed portion attached to said housing, said fixed portion having photoelectronic conversion means for outputting a signal varying according to the quantity of incident light varied in synchronism with the rotation of said rotating portion, said first rotating portion and said photoelectric conversion means comprising a first reference signal detecting means for generating a first reference signal each time the crankshaft rotates by a first predetermined angle and a position signal detecting means for generating a position signal each time the crankshaft rotates by a second predetermined angle which is smaller than the first predetermined angle; and an electromagnetic pickup comprising a second rotating portion fixed to said rotor shaft so as to rotate with said rotor shaft as one body and a second fixed portion integrally attached to said housing, said second fixed portion having magnetic field detecting means for outputting a signal varying according to the magnetic field which is varied in synchronism with the rotation of said second rotating portion, said second rotating portion and said magnetic field detecting means comprising a second reference signal detecting means having substanitally the same function as that of said first reference signal detecting means, said second reference signal detecting means generating a second reference signal each time the crankshaft rotates by a third predetermined angle;

said first and second rotating portions being fixed to said rotor shaft with a predetermined positional relation to each other, said photoelectric conversion means and said magnetic field detecting means being fixed to said housing with a predetermined positional relation to each other in relation to said positional relation of said first and second rotating portion;

one of said photoelectric pickup and said electromagnetic pickup being used as the backup for the other.

2. A rotational signal detecting apparatus according to claim 1, wherein said first reference signal detecting means rotating portion and said photoelectric conversion means outputs a first reference signal each time said crankshaft rotates by a first predetermined angle which is equal to an integer times 360/n (where n is the number of engine cylinders) and wherein said second reference signal detecting means outputs a second reference signal each time said crankshaft rotates by a third predetermined angle which is equal to an integer times said first predetermined angle.

3. A rotational signal detecting apparatus according to claim 2, wherein assuming that n is 4, said first predetermined angle is 90° and said second predetermined angle is 1°.

4. A rotational signal detecting apparatus according to claim 1, wherein the fixed portion and the rotating portion of said electromagnetic pickup and the fixed portion and the rotating portion of said photoelectric pickup are arranged on substantially the same plane.

5. A rotational signal detecting apparatus according to claim 4, wherein the rotation portions of said photoelectric pickup and said electromagnetic pickup are integrally fixed to said rotor shaft and the fixed portions of said photoelectric pickup and said electromagnetic pickup are arranged to be adjacent each other.

6. A rotational signal detecting apparatus according to claim 2, wherein the rotating portion of said photoelectric pickup includes a slit rotating plate having at least one row of slits arranged concentrically with respect to said rotor shaft, and wherein said photoelectric conversion means includes light emitting means and light receiving means arranged so as to face each other via said row of slits in said slit rotating plate, and said light receiving means outputs a signal varying in synchronism with the rotation of said rotor shaft.

7. A rotational signal detecting apparatus according to claim 6, wherein said photoelectric pickup functions as said the other pickup and said slit rotating plate includes a first row of slits arranged concentrically with said rotor shaft at an interval of said first predetermined angle and a second row of slits arranged at an interval of said second predetermined angle, and wherein said photoelectric conversion means includes a first light emitting device and a first light receiving device arranged so as to face each other via said first row of slits as well as a second light emitting device and a second light receiving device arranged so as to face each othr via said second row of slits.

8. A rotational signal detecting apparatus according to claim 6, wherein said photoelectric conversion means functions as said one pickup and said slit rotating plate includes at least a third row of slits arranged concentrically with said rotor shaft at an interval of said third predetermined angle.

9. A rotational signal detecting apparatus according to claim 2, wherein the rotating portion of said electromagnetic pickup comprises rotating plate having at least one row of magnets arranged concentrically with said rotor shaft, and wherein said magnetic field detecting means includes at least one magnetic field detecting device disposed so as to face said row of magnets on said rotating plate, and said magnetic field detecting device outputs a signal varying in synchronism with the rotation of said rotor shaft.

10. A rotational signal detecting apparatus according to claim 9, wherein said electromagnetic pickup functions as said the other pickup and said rotating plate includes a first row of magnets arranged in the circumferential direction at an interval of said first predetermined angle and a second row of magnets arranged in the circumferential direction at an interval of said second predetermined angle, and wherein said magnetic field detecting means includes a first magnetic field detecting device facing said first row of magnets and a second magnetic field detecting device facing said second row of magnets.

11. A rotational signal detecting apparatus according to claim 9, wherein said electromagnetic pickup functions as said one pickup, and said rotating plate includes at least a row of magnets arranged in the circumferential direction at an interval of said third predetermined angle.

12. A rotational signal detecting apparatus according to claim 3, wherein said third predetermined angle is 180°.

13. A rotational signal detecting apparatus according to claim 1, wherein said photoelectric pickup and said electromagnetic pickup ar housed in said housing together with a distributor, and a distribution rotor of said distributor.

14. A rotational signal detecting apparatus according to claim 1, wherein waveform shaping circuits supplied with output signals of said photoelectric pickup and said electromagnetic pickup are fixed to said housing.

* * * * *